United States Patent [19]

Wilt

[11] 4,312,502

[45] Jan. 26, 1982

[54] SHEET STACK INVERTING APPARATUS

[75] Inventor: Donald R. Wilt, Medford, N.J.

[73] Assignee: Molins Machine Company, Inc., Cherry Hill, N.J.

[21] Appl. No.: 143,973

[22] Filed: Apr. 25, 1980

[51] Int. Cl.[3] ..... B65H 1/22

[52] U.S. Cl. ..... 271/3.1; 271/151; 271/186; 414/33; 414/330

[58] Field of Search ..... 271/151, 3.1, 213, 214, 271/186; 414/33, 330

[56] References Cited

U.S. PATENT DOCUMENTS 3,643,939 2/1972 Nussbaum ..... 271/10 X 4,046,369 9/1977 Kluge ..... 271/151 X

FOREIGN PATENT DOCUMENTS 1026617 4/1953 France ..... 271/213

*Primary Examiner*—Richard A. Schacher

*Attorney, Agent, or Firm*—Seidel, Gonda, Goldhammer & Panitch

[57] ABSTRACT

The apparatus lifts a stack of sheets, turns the stack, and then places the side edges of the sheets on a conveyor. The lifting device is generally Z-shaped and is supported for unidirectional rotation about a horizontal axis adjacent one end of the conveyor. Two stacks of sheets are delivered to the conveyor per revolution of said device. The sheets are fed from said conveyor to a shingling conveyor which delivers a uniform shingle to a converting machine. The shingle density is controlled by a metering gate.

10 Claims, 9 Drawing Figures

FIG. 7
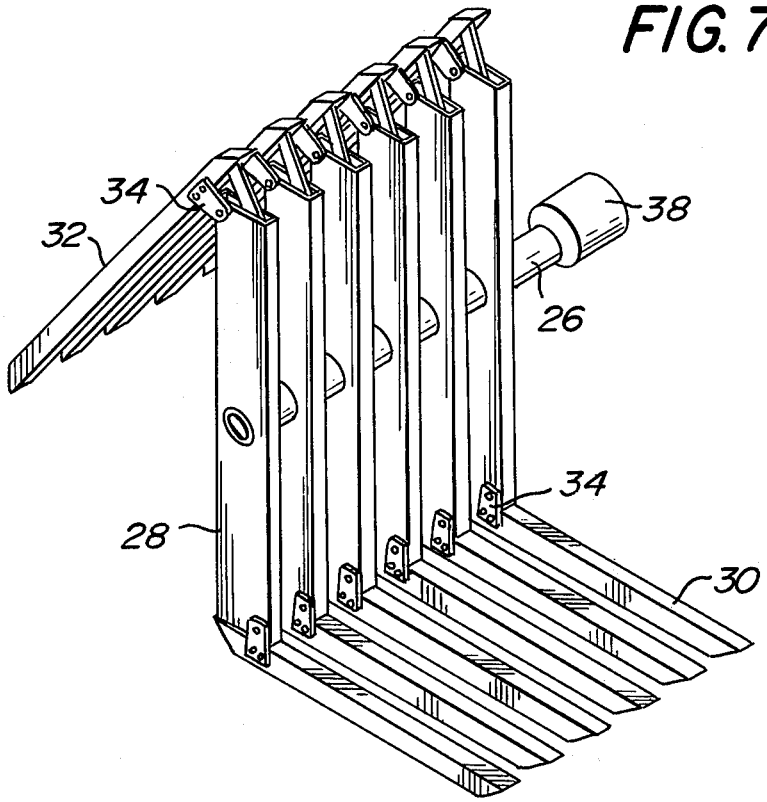
FIG. 9
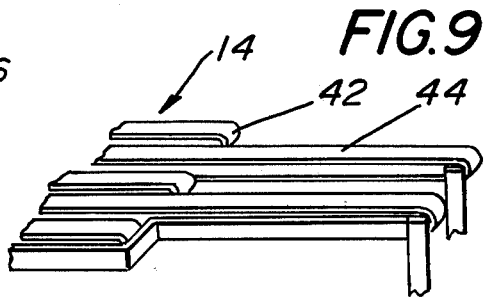
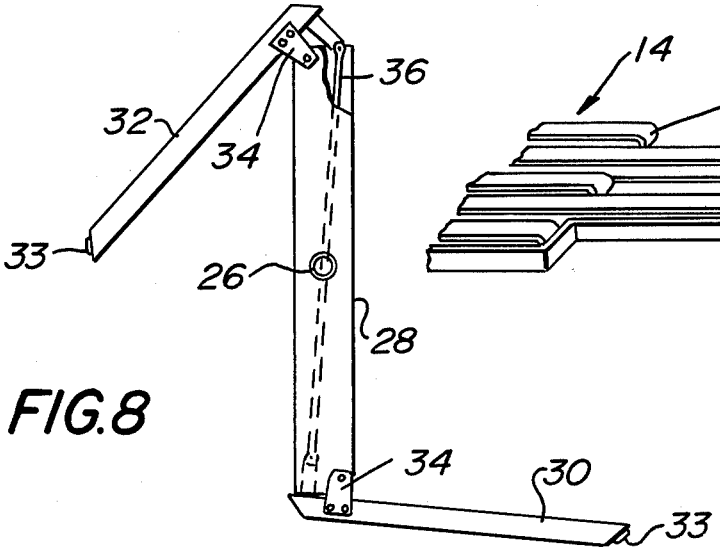
FIG. 8

SHEET STACK INVERTING APPARATUS

BACKGROUND

A wide variety of apparatus is known for inverting stacks of sheets of corrugated paperboard. For example, see U.S. Pat. Nos. 2,776,831; 3,422,969; 3,643,939; 3,885,781; 3,982,750; 4,022,322; and 4,042,234. The lifting device in each of said patents is generally L-shaped and is operated by a cylinder or other motor for pivotable movement whereby it oscillates from a loading position to a delivery position. The generally L-shaped devices in said patents oscillate back and forth and constitute a potential safety hazard to personnel. The present invention is directed to a solution of the problem of how to increase safety.

SUMMARY OF THE INVENTION

The invention is directed to apparatus for lifting and turning a stack of sheets. Therefore, the sheets are shingled on a shingling conveyor having an inlet end for receiving sheets and for conveying the same in a predetermined direction to a hopper or the like. A storage conveyor is provided adjacent to the inlet end of said shingling conveyor for receiving the stack of sheets from the turning device and then depositing the sheets on said shingling conveyor. The turning device is generally Z-shaped and is supported for rotation about an axis generally perpendicular to said direction. A motor means is coupled to said device for rotating said device about said axis so that two stacks of sheets may be delivered to said storage conveyor per revolution of said device.

It is an object of the present invention to provide apparatus for lifting and inverting a stack of sheets in a manner which is substantially continuous, utilizes a minimum amount of floor space, eliminates the need for a pit in the floor, and functions in a manner which maximizes operator safety.

It is an object of the present invention to provide sheet stack inverting apparatus which has two pickup positions and rotates in one direction only, at approximately one half the speed of oscillating prior art devices and as a result thereof minimizes any hazard to personnel.

Other objects will appear hereinafter.

For the purpose of illustrating the invention, there is shown in the drawings a form which is presently preferred; it being undersood, however, that this invention is not limited to the precise arrangements and instrumentalities shown.

FIG. 7 is a perspective view of the turning device.

FIG. 8 is a side elevation view of the turning device.

FIG. 9 is a partial perspective view of the inlet end of the storage conveyor.

DETAILED DESCRIPTION

Figure 1:
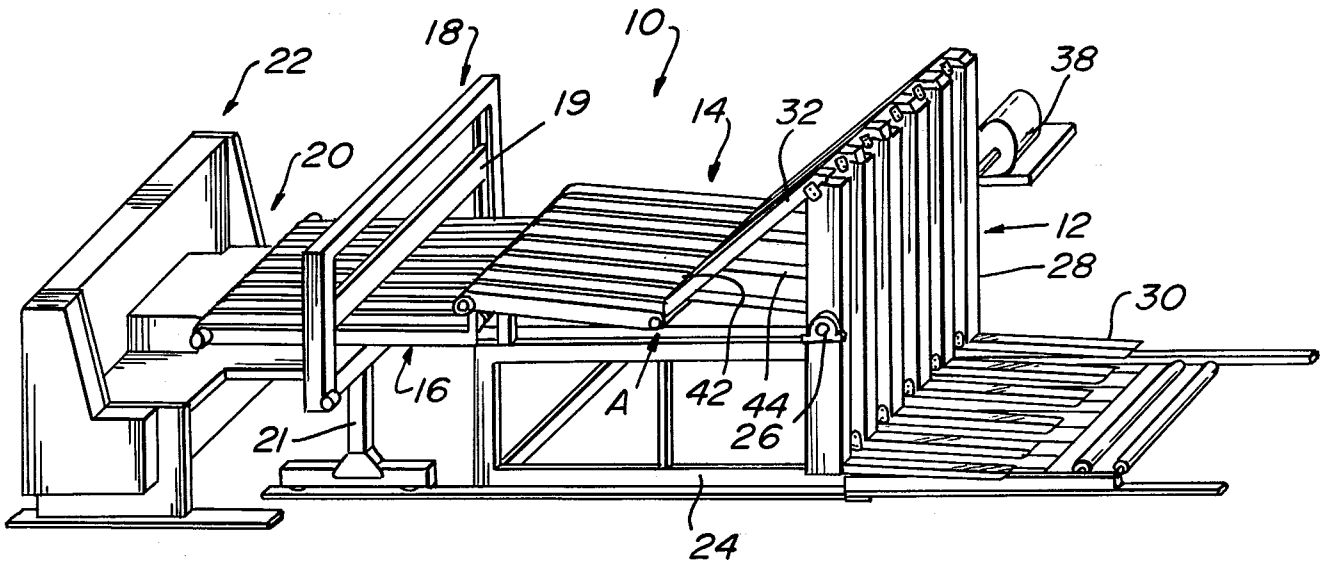
FIG. 1 is a perspective view of apparatus in accordance with the present invention.

Referring to FIG. 1, there is shown apparatus designated generally as 10 for lifting and inverting a stack of sheets and shingling the sheets. The apparatus 10 includes an inverting device 12 adjacent the inlet end of a storage conveyor 14. The outlet end of the storage conveyor 14 is above and adjacent to the inlet end of a shingling conveyor 16 which delivers the shingled sheets to a hopper 20 on a converting device such as a printer slotter 22. Associated with the shingling conveyor 16, there is provided a metering gate designated generally as 18. The gate 18 includes a vertically adjustable metering plate 19 for controlling the height of the shingle and a mobile frame 21 which is mounted on wheels and positionable at any desired location along the conveyor 16.

The apparatus 10 includes a frame 24 for supporting the storage conveyor 14 and the turning device 12. The device 12, as shown more clearly in FIGS. 1, 7 and 8, includes a plurality of struts 28 fixedly secured to a common shaft 26. The struts 28 are preferably rectangular tubes whereby the side faces of the struts cooperate to define a support surface. Also, special molds and/or machining are avoided. Each of the struts 28 has a tine 30 pivotably connected to one end by a bracket 34 and a tine 32 pivotably connected to the other end by a similar bracket 34. Each tine has a bearing 33 which slides on a horizontal track below conveyor 14 as device 12 rotates. The tines 30, 32 associated with each strut 28 are interconnected by a discrete rigid rod 36.

When the tines 30 assume the position as shown in FIGS. 1, 7 and 8 due to gravity, they push the rods 36 upwardly so as to pivot the tines 32 to the position shown in FIGS. 1, 7 and 8. As shown in FIG. 8, the included angle between tine 32 and its strut 28 is approximately 45°. As shown more clearly in FIG. 8, the distance between the free ends of the tines 32 and the axis of shaft 26 corresponds generally to one half the length of the struts 28. This interrelationship of strut 28 and tines 30, 32 reduces the overall height of the device 12 so that it can be closer to ground level when it rotates and minimizes the length of the turn-over operation.

The shaft 26 is supported by bearings on the frame 24. A motor means is provided to rotate shaft 26. As shown, shaft 26 is connected to the output of a motor 38. Motor 38 rotates the device 12 in one direction. Other motor means such as a pair of hydraulic cylinders could be used to rotate device 12. For every revolution of the device 12, two stacks of sheets will be lifted and inverted onto the storage conveyor 14. One of the stacks will be lifted by the tines 30 and the other will be lifted by the tines 32. The unidirectional rotation of the device 12 may be at a substantially lower speed as compared with the speed of oscillating designs of the prior art and may as low as 1.5 rpm. This slow speed and the use of only unidirectional rotation minimizes any hazard to the safety of personnel while simplifying the inverting device control.

Referring to FIG. 9, the inlet end of the storage conveyor 14 has fewer belts than the outlet end thereof. Thus, every other belt such as belts 40, 42 on conveyor 14 extend forwardly and define the inlet end for receiving a stack from the inverting device 12. The rollers at the inlet ends of the belts 40 and 42 are separately supported by upstanding legs. See FIG. 9. By only extending every other belt to the inlet end of the conveyor 14, there is provided a gap between adjacent belts to facilitate passage of the struts 28 and the tines 30, 32 during the unidirectional rotation of device 12.

Figure 2:
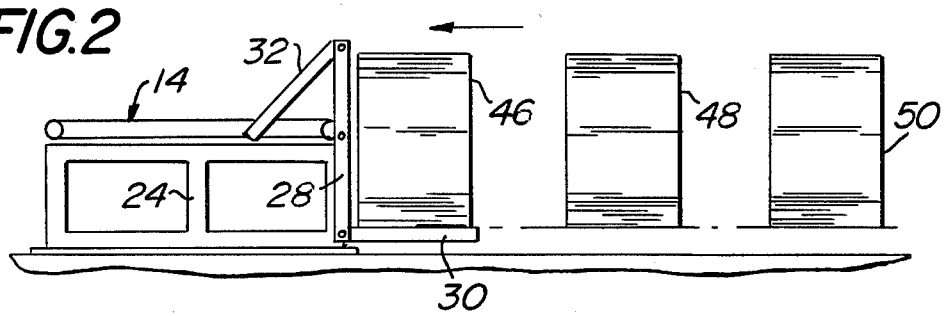
FIGS. 2–6 are diagramatic illustrations of a sequence of operations.
Figure 3:
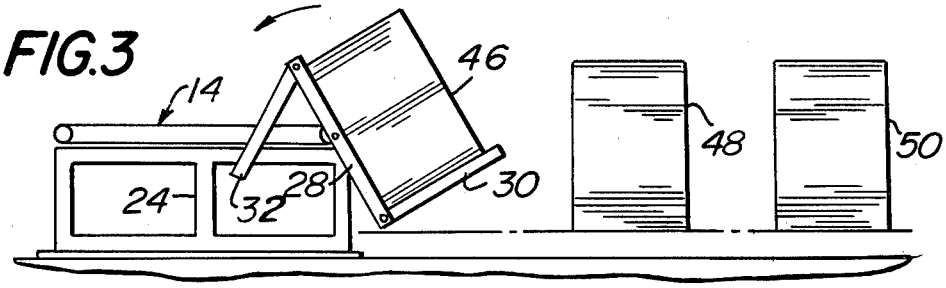

In FIGS. 2–6 there is diagramatically illustrated a sequence of operations of the manner in which the present invention is utilized. Stacks of sheets of corrugated paperboard designated 46, 48 and 50 are sequentially conveyed to the turning device 12 by roller conveyors, forklift trucks, or the like. The apparatus may be operator controlled for intermittant operation. The device 12 if desired can be provided with limit switches to cause it to temporarily come to a stop position when the struts 28 are vertically disposed as shown in FIG. 2. Stack 46 is transferred onto the tines 30 and device 12 rotates as shown in FIG. 3.

Figure 4:
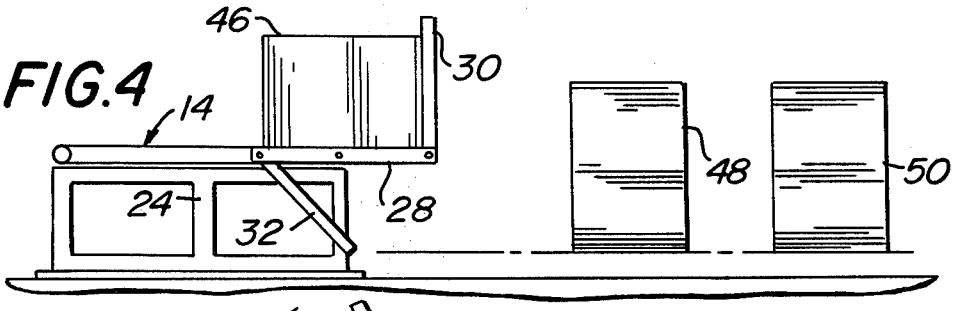
Figure 5:
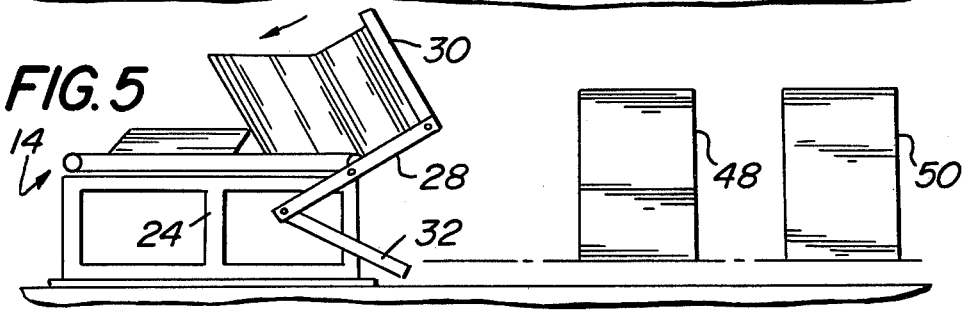

When the device 12 reaches the position as shown in FIG. 4, the side edges of the sheets are supported by the storage conveyor 14. Any defective sheets are pulled out of the stack 46 by the operator. Device 12 then rotates to the position as shown in FIG. 5, so that the sheets slide onto conveyor 14. Interference between any of the tines and the sheets on conveyor 14 is prevented by stopping motor 38 either by the operator or by use of a photoelectric control. When the shingled sheets have passed point A on conveyor 14, tines 30 may then move between the belts. At this point in time, the tines 32 are already receiving a new stack 48. The sequence is repeated so that for each revolution of the device 12, two stacks are lifted and inverted onto the storage conveyor 14.

Figure 6:
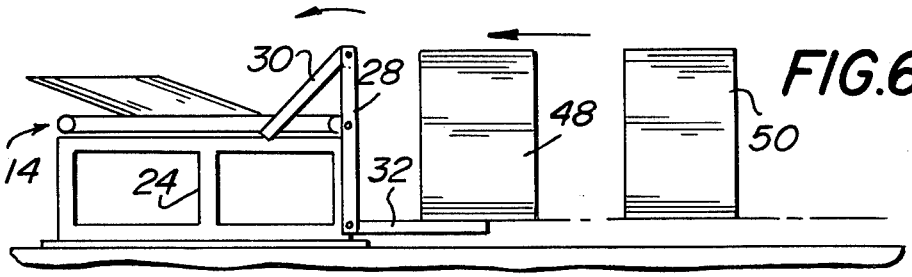

When the struts 28 of the device 12 are vertically disposed, the tines at the upper end thereof are angled downwardly at an angle at approximately 45° with respect to the vertical. Such angular disposition of tines 32 in FIG. 7 is attained by the effect of gravity, due to the pivotable mounting of the tines, as well as the positive action resulting from the rods 36. Referring to FIGS. 5 and 6, as the struts 28 become upright the tines 32 pivot to a horizontal disposition until they contact the bottom end of their associated strut 28. This causes each of the rods 36 to move upwardly and positively pivot the uppermost tines such as tines 30 in FIG. 6 to the angularly downwardly position. Rods 36 control the timing of the pivoting of the tines and control the speed at which the tines pivot thereby adding to operator safety.

The apparatus 10 can operate with only one electrical motor. If desired, a separate electrical motor may be utilized for driving conveyors 14 and 16. The apparatus 10 can be used in environments where a source of pressurized air is unavailable since there are no pnuematic cylinders on device 10.

The present invention may be embodied in other specific forms without departing from the spirit or essential attributes thereof and, accordingly, reference should be made to the appended claims, rather than to the foregoing specifications, as indicating the scope of the invention.

I claim:

1. Apparatus for lifting and turning a stack of sheets comprising a first conveyor having an inlet end for receiving sheets and conveying the same in a predetermined direction, a device for lifting a stack of sheets up to the elevation of and for depositing the sheets on a second conveyor which conveys the sheets to the inlet of said first conveyor, the improvement comprising said device being generally Z-shaped, means supporting said device for rotation about an axis generally perpendicular to said direction, a motor means coupled to said device for rotating said device about said axis so that two stacks of sheets may be delivered to said conveyor per revolution of said device.

2. Apparatus in accordance with claim 1 wherein said device includes a plurality of struts disposed parallel to one another with tines extending from the ends of said struts in opposite directions.

3. Apparatus in accordance with claim 2 wherein said tines have one end pivotably connected to an end of one of the struts and are supported as cantilever tines by the struts.

4. Apparatus in accordance with claim 3 wherein the tines associated with one of the struts are interconnected by a member extending generally longitudinally within the associated strut.

5. Apparatus in accordance with claim 1 wherein said second conveyor has spaced conveyor belts defining gaps between adjacent belts and through which portions of the device may pass during rotation of the device.

6. Apparatus in accordance with claim 1 including an adjustable gate for controlling the height of shingled sheets downstream from said device, and a frame supporting said gate, said frame being mounted for adjustable positioning thereof along the length of said first conveyor.

7. Apparatus for lifting and inverting a stack of sheets comprising a generally Z-shaped device, means supporting said device for unidirectional rotation about a horizontal axis, a motor means coupled to said device for rotating said device in said direction about said axis so that two stacks of sheets may be inverted by said device per revolution of said device, said device including a plurality of spaced parallel members supported by a shaft for rotation about said axis, and discrete tines connected to each end of each member, said tines extending in opposite directions from the ends of each member as a set to define two stack supporting platforms.

8. Apparatus in accordance with claim 7 wherein each tine is pivotably connected to an end of its associated member for limited pivotable movement.

9. Apparatus in accordance with claim 8 including a moveable member interconnecting the pivotably mounted end of each tine associated with one of said members so that when one set of tines is perpendicular to said members the other set of tines is at an acute angle with respect to said members.

10. Apparatus for lifting and turning a stack of sheets comprising a conveyor having an inlet end for receiving sheets and conveying the same in a predetermined generally horizontal direction, a device for lifting a stack of sheets up to the elevation of and for depositing the sheets on said inlet end of said conveyor, frame means supporting said device for rotation about a generally horizontal axis which is generally perpendicular to said direction, said device including a plurality of struts disposed parallel to one another, a discrete tine pivotably connected to each end of each strut, the tines on one strut extending in opposite directions, a member interconnecting the tines associated with a single strut so that when the tine at one end is substantially perpendicular to its strut the tine at the other end is disposed at an acute angle with respect to its strut, and motor means coupled to said device for rotating said device in one direction about said axis so that each set of tines will deliver a stack of sheets per revolution of said device.

* * * * *